US005184482A

United States Patent [19]

Cloud

[11] Patent Number: 5,184,482

[45] Date of Patent: Feb. 9, 1993

[54] EAR ORNAMENT

[76] Inventor: Shirley F. Cloud, 402 Clearview, San Antonio, Tex. 78228

[21] Appl. No.: 687,235

[22] Filed: Apr. 18, 1991

[51] Int. Cl.[5] ..... A44C 7/00

[52] U.S. Cl. ..... 63/14.1; 63/12; D11/40

[58] Field of Search ..... 63/12, 13, 14.1, 1.1, 63/14.8, 2; D11/1, 2, 40, 42, 46, 86, 87, 88

[56] References Cited

U.S. PATENT DOCUMENTS

| | | | |
|---|---|---|---|
| 236,935 | 1/1881 | Claude | 63/12 |
| D. 299,119 | 12/1988 | Frederick | D11/40 |
| D. 301,700 | 6/1989 | Coleman | D11/88 |
| D. 317,422 | 6/1991 | Hardy | D11/42 |
| 1,561,128 | 11/1925 | Waller | 63/12 |
| 1,576,372 | 3/1926 | Shea . | |
| 1,732,250 | 10/1929 | Wehse | 63/12 |
| 2,409,369 | 10/1946 | Lo Curto | 63/14 |
| 2,914,928 | 12/1959 | Warden | 63/14 |
| 3,898,868 | 8/1975 | Tomlinson | 63/2 |
| 4,282,721 | 8/1991 | Roach | 63/14.1 |
| 4,827,738 | 5/1989 | Rothal | 63/14.1 |
| 4,993,240 | 2/1991 | Pounder | 63/12 |

*Primary Examiner*—Renee S. Luebke
*Assistant Examiner*—F. Saether
*Attorney, Agent, or Firm*—David A. Rose

[57] ABSTRACT

The ear ornament is a continuous member completely extending around the ear. The continuous member has an upper engaging portion resting on the bridge of the ear, a rear portion passing through the channel defined by the pinna of the ear, a lower non-engaging portion extending adjacent to earlobe of the ear, and a front portion extending in front of the ear. The continuous member may include a fastener means for connecting adjacent free ends of a member. A decorative ornament may be integral with a continuous member or be attachable to the continuous member for decoration.

14 Claims, 8 Drawing Sheets

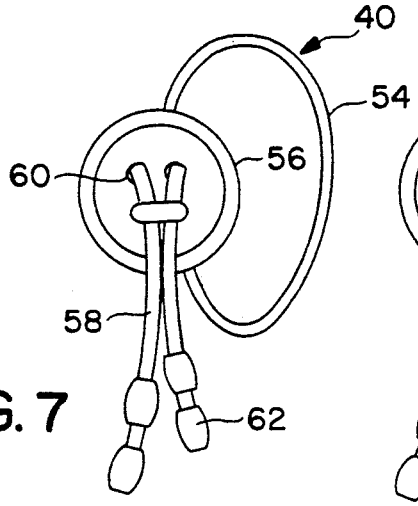
FIG. 7
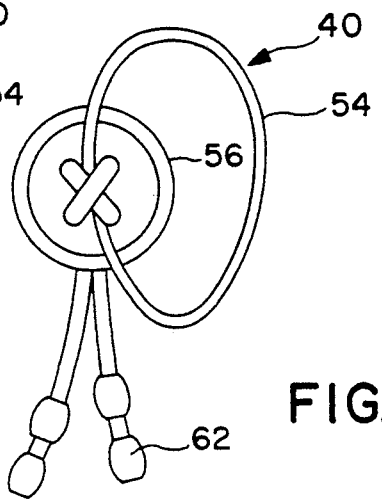
FIG. 8
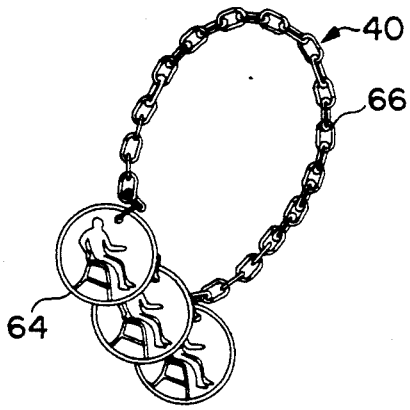
FIG. 9
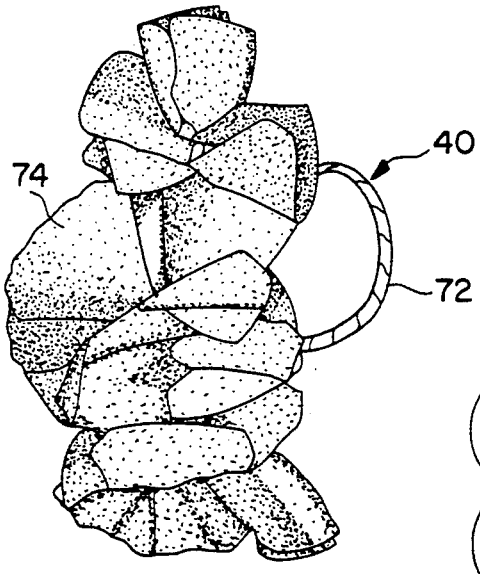
FIG. 11
FIG. 13
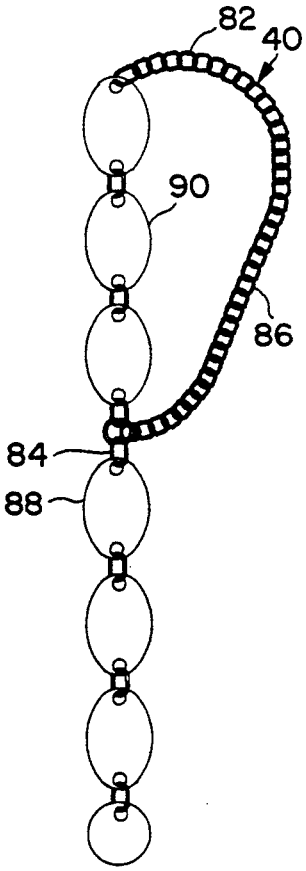
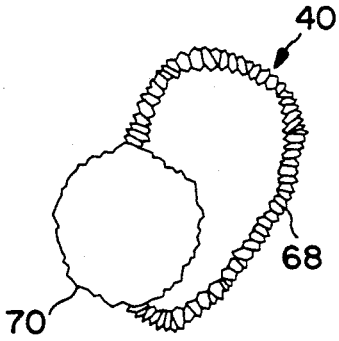
FIG. 10
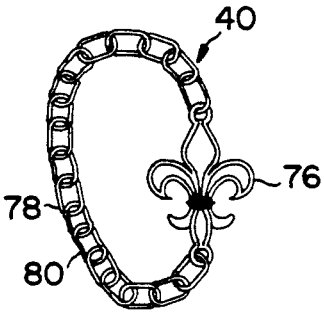
FIG. 12

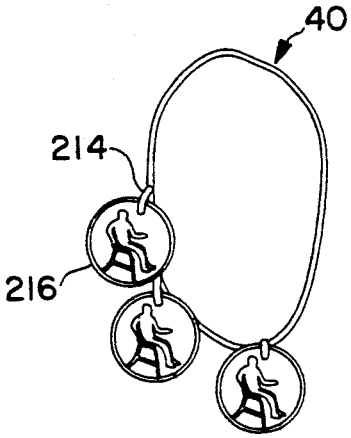
FIG. 46
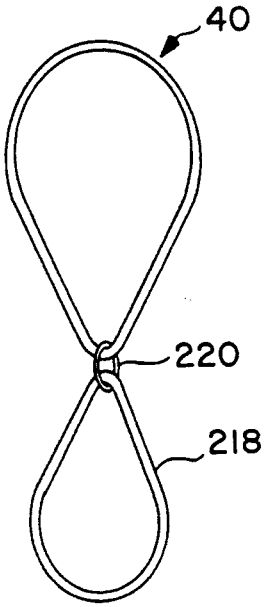
FIG. 47
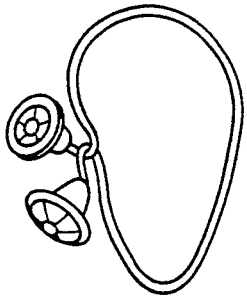
FIG. 48
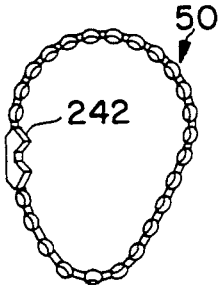
FIG. 49
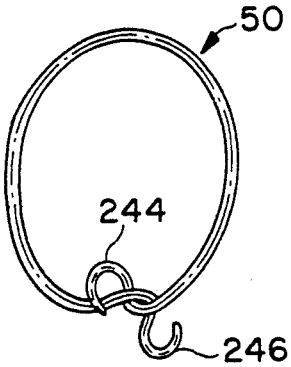
FIG. 50
FIG. 51
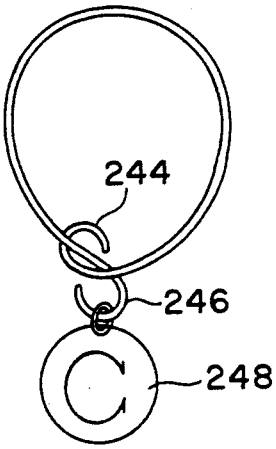
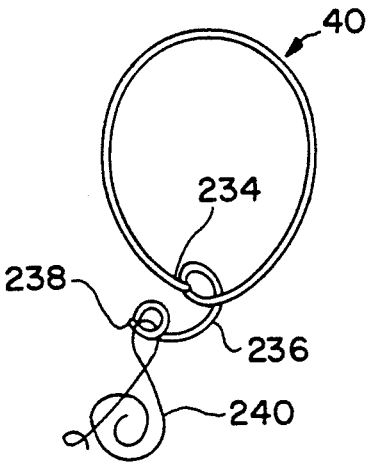
FIG. 52
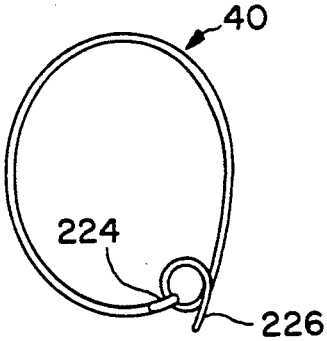
FIG. 53
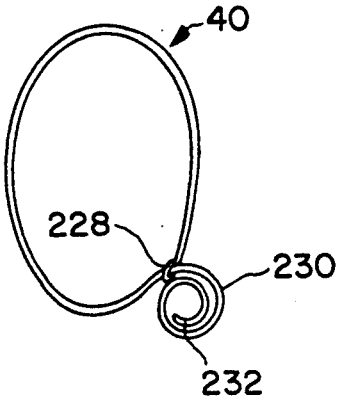
FIG. 54

EAR ORNAMENT

BACKGROUND OF INVENTION

The present invention relates to costume jewelry and more particularly to ornaments for the ear such as earrings.

Earrings, which are so popular and common among fashion conscious people, are generally retained to the ear by being clamped to the earlobe, or, in the case of earrings for pierced ears, by passing through a perforation in the earlobe for firm retention. Earrings for pierced ears commonly include a post passing through the perforation in the earlobe with a retaining device attached to the protruding portion of the post behind the earlobe.

Earrings which snap or clamp to the ears or which require a post through the perforation in the earlobe are often extremely uncomfortable and irritable to the wearer. Clamping devices cause great discomfort due to the pressure placed upon the earlobe by the clamp or clip of the earring. A common problem for many clamp-type earrings are that they are painfully tight and squeeze the earlobes. Often such earrings are frequently lost. The whole technique of pierced ears has its own array of disadvantages from the operation itself such as infection, scarring and tearing of the lobe during installation. Piercing type earrings possess other problems such as removal upon pulling the earring once worn as well as the expense and discomfort of the ear-piercing operation. Also, there is the possibility that the earring may come loose and therefore lost.

Further, prior art earrings require that the ornament be permanently affixed to the post or clip. The ornaments for the earring cannot be changed without using jeweler's tools and thus, a jeweler is usually needed to change ornaments on the earrings.

Ear ornamentation in the past has usually been designed and manufactured to be worn on or directly below the earlobe. This fact being partly due to the dictates of fashion and availability or lack of availability of retained devices that would allow alternative positioning of the ornament about the ear.

Several prior art patents including U.S. Pat. Nos. 2,409,369; 2,914,928; 4,282,721; and 4,827,738 disclose an ear ornament which is basically C-shaped and do not use clamps or posts. The C-shaped ear ornament of these prior art patents rest on the top of the ear and extend around the back of the ear with the lower end protruding in front of the earlobe for the suspension of an appropriate ornament. U.S. Pat. No. 2,409,369 discloses a telescoping C-shaped ear ornament which is adjustable to being secured on ears of all sizes. U.S. Pat. No. 2,914,928 discloses an ear ornament with an oscillating ornament support. The C-shaped ear ornament includes an upper and lower loop connected together by a spring biased connection for assuring a snug fit to the ear. U.S. Pat. No. 4,282,721 discloses a C-shaped ear ornament made of a curved rod member having a threaded lower end for threadingly attaching different ornaments. U.S. Pat. No. 4,827,738 discloses a C-shaped ear ornament having coiled bands on each end for supporting jump rings of various ornaments. The C-shaped ear ornament of the above-identified patents rests the upper curvature of the C-shaped ear ornament on the upper helix of the ear with the medial portion of the C-shaped ear ornament supported by the post auricle groove of the ear. U.S. Pat. No. 3,898,868 combines a C-shaped ear ornament with a forehead engaging tiara and U.S. Pat. No. 1,576,372 discloses a C-shaped earring safety guard.

C-shaped ear ornaments have the disadvantage of coming loose from the ear and thus lost. Further, C-shaped ornaments have the further disadvantage of placing pressure on the upper helix and lower earlobe of the ear and thus are not comfortable.

Accordingly, there is a need for resolving the aforementioned problems and deficiencies associated with the prior art earrings for securing ornamentation to and around the ear. The present invention is directed to a solution of these problems and deficiencies.

SUMMARY OF THE INVENTION

The present invention includes an ear ornament in the shape of a continuous loop which completely circumscribes the ear. The ear ornament may be made of a rigid material such as a metal wire or plastic or of a flexible material such as a light chain, leather or cloth. The ear ornament may include a fastener to open the loop of the ear ornament for the attachment of one or more ornaments.

Other objects and advantages of the invention will appear from the following description.

BRIEF DESCRIPTION OF THE DRAWINGS

For a detailed description of a the preferred embodiment of the invention, reference will now be made to the accompanying drawings wherein:

FIG. 7 is a view in elevation of the ear ornament of a pliable material with an alternative detachable ornament;

FIG. 8 is a back view of the ear ornament and detachable ornament shown in FIG. 7;

FIG. 9 ia a view in elevation of the ear ornament made of a light chain with attachable ornaments;

FIG. 10 is a view in elevation of the ear ornament having a beaded wire with an attached rosette pattern;

FIG. 11 is a view in elevation of the ear ornament made of a floral wire surrounded with ribbon with artificial flowers attached;

FIG. 12 is a view in elevation of the ear ornament made of a chain having an integral ornament in the chain;

FIG. 13 is a view in elevation of the ear ornament made of a chain having an extra length of chain extending from the ornament together with integrated accessory ornaments;

FIG. 46 is a view in elevation of the ear ornament made of a light metal wire having loops with attached decorative ornaments;

FIG. 47 is a view in elevation of the ear ornament made of a rigid or pliable metal with a decorative ornament of a similar design attached;

FIG. 48 is a view in elevation of the ear ornament with hooks having attached decorative ornaments on the terminal ends of the hooks;

FIG. 49 is a view in elevation of the ear ornament made from a loop of chain with a ball look;

FIG. 50 is a view in elevation of the ear ornament with ornamental hooks having one ornamental hook extending to the inside of the loop and another ornamental hook extending to the outside of the loop;

FIG. 51 is a view in elevation of the ear ornament with ornamental hooks extending to the inside and outside of the loop with the outside ornamental hook having a detachable decorative ornament;

FIG. 52 is a view in elevation of the ear ornament made of a light wire having a loop in one end and the other end threaded through the loop with a decorative ornament suspended from the wire;

FIG. 53 is a view in elevation of the ear ornament made of a light wire having a loop on one end and the other terminal end being threaded through the loop;

FIG. 54 is a view in elevation of the ear ornament made of a light wire having a loop on one end and having the other end passing through the loop and configured in an ornamental fashion;

DESCRIPTION OF THE PREFERRED EMBODIMENT

Figure 1:
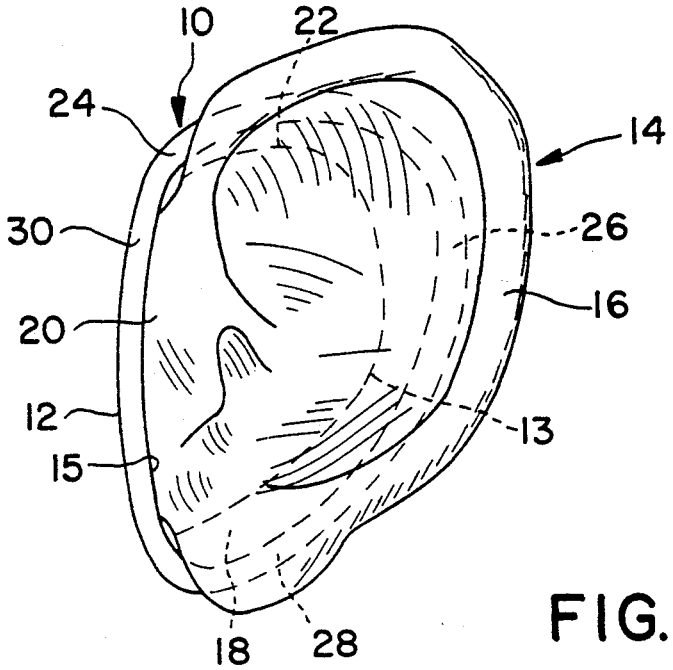
FIG. 1 is a view in elevation of the ear ornament of the present invention installed on the ear.

In the accompanying drawings, and in the following specification, the same reference characters are used to designate the same parts and elements of the present invention throughout the application. For example, the numeral 10 refers to the ear ornament of the present invention in its entirety.

Referring initially to FIG. 1, ear ornament 10 comprises a continuous loop 12 contoured to completely circumscribe the ear 14. The ear ornament 10 encircles the base attachment or cone 13 at the ear entrance where the ear attaches to the head. The ornament 10 encircles the outer part of the auricle 16 of the ear, known as the pinna, and then extends under the earlobe 18, up the center portion 20 of the ear and returns across the bridge and behind the upper helix 22 of the ear. The continuous loop 12, once worn, includes an upper engaging portion 24, a rear portion 26, a lower non-engaging portion 28, and a front portion 30. Upper engaging portion 24 rests on the bridge of the ear 14 behind the upper helix 22. The rear portion 26 rests in the channel defined by the pinna 16 and the head (not shown), inwardly of the helix of the ear 14. The lower portion 28 preferably does not engage the lower portion of the ear but extends adjacent to the bottom of and behind the earlobe 18. The front portion 30 completes the ear ornament 10 so as to fully circumscribe the cone 13 and the pinna 16 of ear 14 to insure stability and attachment of the ear ornament 10.

The opening 15 of continuous loop 12 must be larger than the base attachment or cone 13 of the ear to the head. The Vertical distance of opening 15 must be greater than the distance between the bridge of the ear at the upper helix 22 and the base of the earlobe 18 to insure the loop fits over the ear 14. Further, the circumference must be large enough to receive the outer folds or pinna 16 of the ear 14 to install the ear ornament 10 over the ear 14. Upon securing the ear ornament 10 to the ear, typically the pinna 16 is compressed to slip the ear ornament 10 over the pinna 16. Normally the pinna 16 is larger than the opening 15 of the ear ornament 10 so as to secure ear ornament 10 to the ear 14. The circumference of loop 12 varies very little in size because the outer folds or pinna 16 of the ear 14 protrudes away from the head and the base of earlobe 18 is preferably not in engagement with the ear ornament 10. Ear ornament 10 may be of any shape, as illustrated in the following figures, so long as it completely circumscribes the ear.

The continuous loop 12 may be made of various materials. It can be made from a rigid or pliable metal, preferably a precious metal such as gold, silver, platinum, or alloys thereof, or from less expensive metals such as base metals or plated metals. The loop 12 may also be hollow metal tubing for economy material and weight, if desired. Alternatively, the loop 12 may be made from plain wire, beaded wire, wrapped wire, light chain, pipe cleaners, or the like. Further the loop 12 may be made of a soft flexible material such as ribbon, cloth, leather, plastic, elastic, or the like.

Figure 2:
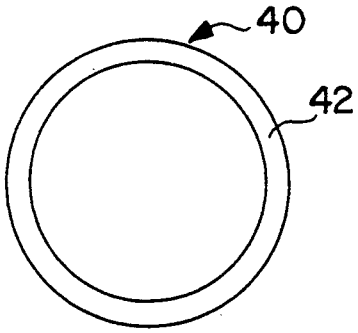
FIG. 2 is a view in elevation of the ear ornament made in rigid or pliable metal.
Figure 3:
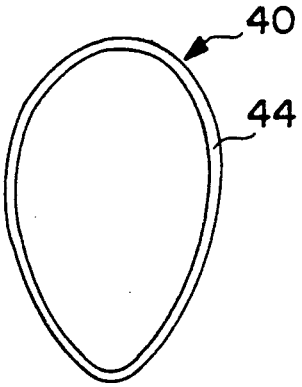
FIG. 3 is a view in elevation of the ear ornament made with an elastic material.
Figure 4:
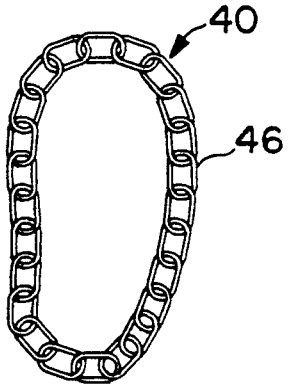
FIG. 4 is a view in elevation of the ear ornament made from a light chain.

The continuous loop 12 may be of two types, namely a continuous, integral loop 40 which has no ends or a continuous, non-integral loop 50 which has adjacent ends fastened together by a fastener means. FIGS. 2–19 illustrate a continuous, integral loop 40 of the ear ornament 10. FIGS. 2–4 and 49 illustrate a plain, integral loop 40 having no ornaments. FIG. 2 illustrates a circular loop 42 made of metal which may be either pliable or rigid. FIG. 3 illustrates an oval or egg-shaped integral loop 44 made of a rigid or pliable material such as metal or plastic or a flexible and pliable material, such as cloth or leather. FIG. 4 illustrates a loop 46 made of a light chain that adapts to the shape of the ear 14. The pliable links allow easy contouring to the pinna 16 located at the rear of the ear 14. Adjustability is provided by removing or adding links depending upon link size.

Figure 5:
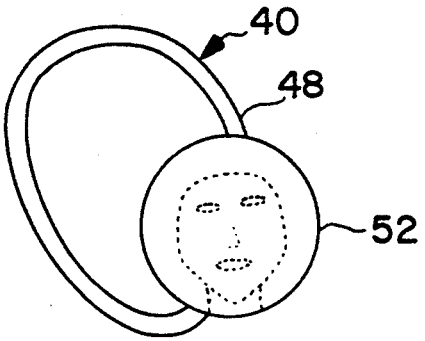
FIG. 5 is a view in elevation of the ear ornament having a detachable ornament.
Figure 6:
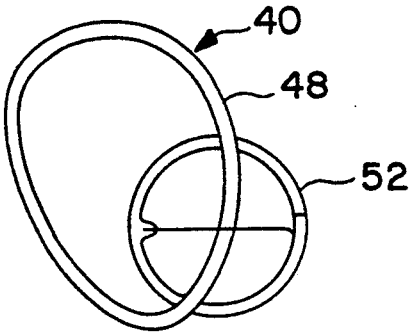
FIG. 6 is a back view of the ear ornament shown in FIG. 5.

FIGS. 5–8 illustrate a continuous, integral loop 40 with a detachable ornament. FIGS. 5 and 6 include an integral loop 48 made of a pliable material, such as cloth or an elastic material, to which a campaign or advertisement button 52 is pinned. FIGS. 7 and 8 illustrates a continuous, integral loop 54 having a button 56 attached thereto by lacing rawhide 58 through the holes 60 in the button. Beads 62 may also be attached to the ends of the rawhide 58.

FIGS. 9–13 and 46–47 illustrate other forms of continuous, integral loops 40. FIG. 9 illustrates the attachment of one or more ornaments 64 to a chain 66 forming the continuous, integral loop 40. FIGS. 10 and 11 show a wire encased in a secondary material. In FIG. 10, small beads 68 have encased a flexible wire (not shown) which continues into a rosette pattern 70. FIG. 11 includes wrapping a floral wire (not shown) with a satin ribbon 72 to which artificial flowers 74 are attached. In FIG. 12, the ornament is integrated into the continuous, integral loop 40. A fleur-de-lis 76 is included in the continuous, integral loop 78 made of chain 80. The accessories can be placed in different positions on the loop 40. FIG. 13 illustrates a longer length of chain 82, a portion of which is used to wrap around and encircle the ear 14 leaving extra links 84 to hang from the continuous loop 86. Additional charms or accessories 88 may be attached or integrated into the loop 86 as at 90. FIG. 46 includes a continuous, integral loop 40 made of a light wire and has loops 214 to which are attached one or more decorative ornaments 216 such as coins or the like. FIG. 47 includes a continuous, integral loop 40 that has attached thereto a decorative ornamental loop 218 of a shape similar to that of loop 40. Decorative ornament 218 is attached to loop 40 by means of a link 220.

Figure 14:
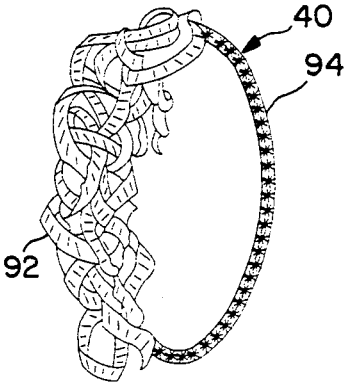
FIG. 14 is a view in elevation of the ear ornament made of a pipe cleaner with attached ribbon.
Figure 15:
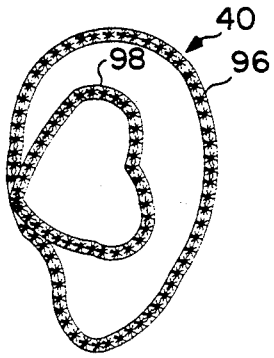
FIG. 15 is a view in elevation of the ear ornament made of a pipe cleaner having an integral ornament also made of a pipe cleaner.
Figure 16:
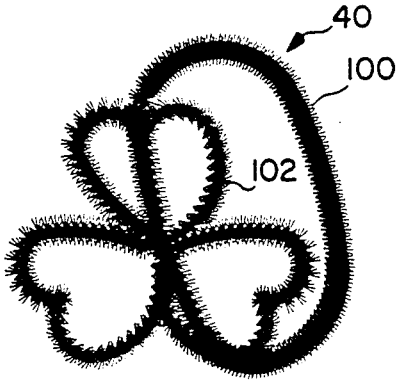
FIG. 16 is a view in elevation of the ear ornament made of a pipe cleaner with an ornament of the same material.
Figure 17:
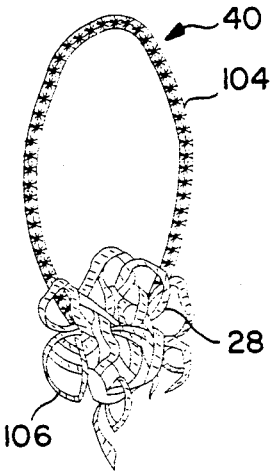
FIG. 17 is a view in elevation of the ear ornament made of a pipe cleaner with lower attached ribbon.
Figure 18:
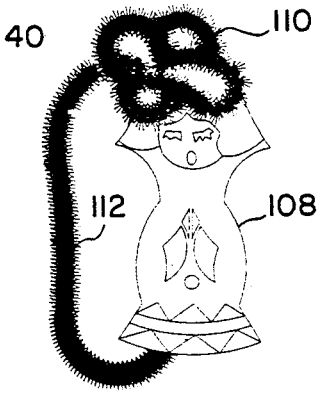
FIG. 18 is a view in elevation of the ear ornament made of a pipe cleaner having both an attached ornament and an ornament of the same material.
Figure 19:
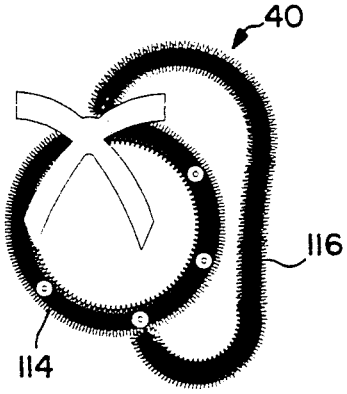
FIG. 19 is a view in elevation of the ear ornament made of a pipe cleaner with an integral ornament also made from the pipe cleaner.
Figure 20:
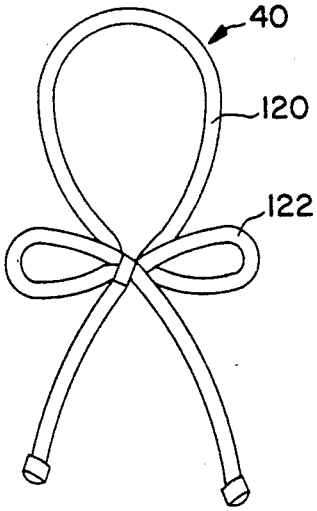
FIG. 20 is a view in elevation of the ear ornament made of a material having its free ends tied to form the continuous loop and also provide decoration.

FIGS. 14–21 and 48–58 illustrate the tying or twisting of the free ends of the loop 40 together to form the continuous encirclement of the ear 14. The loops 40 are a hybrid because the loop is made of a material that forms the continuous loop by tying the ends of the material. In FIGS. 14–19, the ends of the pipe cleaner are twisted together to form the loop 40 and illustrate an ornament with an expressive, festive or holiday theme. The continuous, integral loop 40 is made from a flexible, colorful pipe cleaner which can be adjusted to individual pinna size or readjusted for decorative preference. The decorations are easily attached by such means as gluing, stapling, or tying onto the loop 40. FIG. 14 illustrates a festive ribbon 92 affixed to loop 94. FIG. 15 illustrates the continuation of the loop 96 made of a pipe cleaner to form the heart ornament 98 for Valentine's Day. FIG. 16 also includes the use of a common material on loop 100 to form a 3-leaf clover 102 for St. Patrick's Day. Both loop 100 and clover leaf 102 are made of pipe cleaners. FIG. 17 includes a loop 104 made of a pipe cleaner with a festive ribbon 106 attached on the lower non-engaging portion 28 of loop 104. FIG. 18 illustrates both an attached ornament 108 and ornament 110 on loop 112. The loop 112 and ornament 110 are made of the same material, i.e., pipe cleaners. The ornament 108 could be used as an Easter ornament. FIG. 19 illustrates a wreath 114 made integral with the pipe cleaner loop 116. The continuous integral loop 40 of FIG. 19 is representative of Christmas. In FIG. 20, a florescent material that glows in the dark forms a loop 120 by tying a bow 122 in the free ends of the material.

FIGS. 21 and 52–54 include a loop 40 that is formed into a continuous loop by semi-permanently attaching the ends of the material of the loop. FIG. 53 illustrates a continuous loop 40 made of a light pliable metal material 222 having a loop 224 on one end and another free end 226 passing through the loop and forming a closed loop to semi-permanently attach ends 224, 226. Although the ends 224, 226 may be detached by opening the loop formed by end 226, it is contemplated that this connection of ends 224, 226 is permanent. FIG. 54 illustrates a continuous loop 40 having a loop 228 in one end and a decorative coil 230 forming the other end 232.

Figure 21:
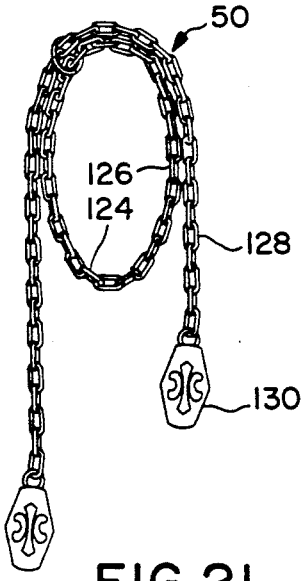
FIG. 21 is a view in elevation of the ear ornament made of an overlapping chain attached together with a jewelry fastener.

FIG. 52 includes the continuous loop 40 having a fastener loop 234 at one end and another end 136 passing through loop 234 and bending around to form its own loop. The free end 238 of end 236 also forms a loop for attaching decorative ornament 240. FIG. 21 illustrates a chain 124 which wraps around and encircles the ear 14 to form loop 126 but leaving extra links 12 to hang both in the front and the rear of the ear 14. Charms 130 are attached to the free ends of the chain 124.

FIGS. 22–45, 49–51 and 55–58 illustrate the continuous, non-integral loop 50 which includes a fastener means for connecting the ends to form the continuous loop. The fastener means may include attaching the loop end to end with a clasp, eye-hook, screw-threaded device, or other manner whereby the two ends can be self-connected together to make a complete continuous loop. FIG. 49 illustrates a continuous, non-integral loop 50 made of a chain having a ball and socket connection 242 for connecting the ends of the chain.

Figure 22:
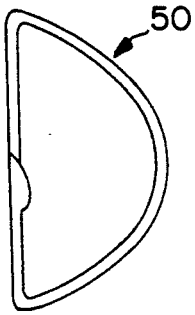
FIG. 22 is a view in elevation of the ear ornament made of a spring wire having a self-connecting clasp.
Figure 23:
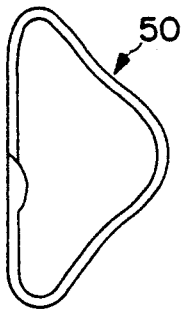
FIG. 23 is a view in elevation of the ear ornament of FIG. 22 having a different shape.
Figure 24:
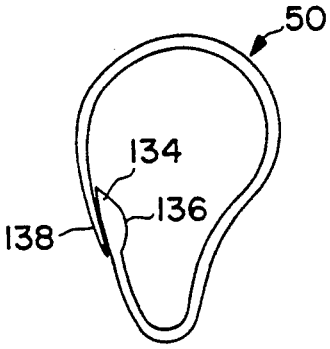
FIG. 24 is a view in elevation of the ear ornament of FIG. 22 having a still different shape with the clasp open.

FIGS. 22–24 illustrate a continuous, non-integral loop 50 having fastener means such as self-connecting or self-connected clasps. The loops 50 are made of spring metal which allows adjustment through applied pressure. One free end 134 of the loop includes an arcuate cradle 136 for receiving the other free end 138 of the loop 50. By applying pressure to end 138 of the loop 50, end 138 may be moved into position for receipt by the cradle 136 for fastening the two ends 134, 138 together to form a continuous, non-integral loop. The spring force of the spring metal maintains the end 138 within the cradle 136.

Figure 25:
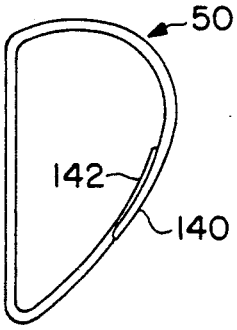
FIG. 25 is a view in elevation of the ear ornament having alternative embodiment of the clasp of FIG. 22.
Figure 26:
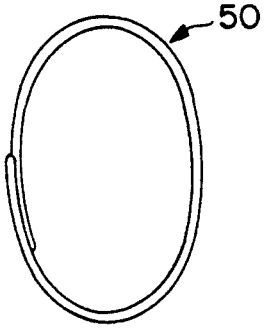
FIG. 26 is a view in elevation of the ear ornament of FIG. 25 with an oval shape.
Figure 27:
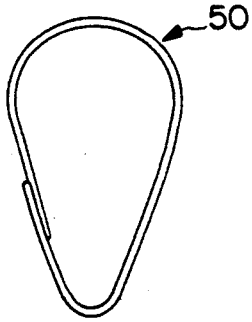
FIG. 27 is a view in elevation of the ear ornament of FIG. 25 with a teardrop shape.

FIGS. 25–27 illustrate another type of fastener means similar to that of FIGS. 22–24. Instead of the cradle 136, one end 140 of the spring metal is hollowed so as to form a groove to receive the other free end 142 of the loop 50.

FIGS. 22–27 also illustrate the various shapes of loop 50.

Figure 28:
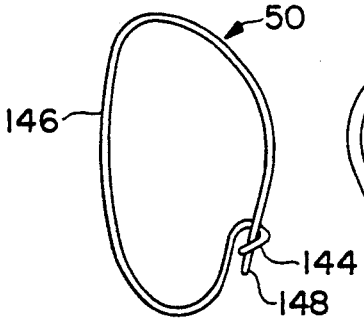
FIG. 28 is a view in elevation of the ear ornament having a hook on one end to receive the other free end.
Figure 29:
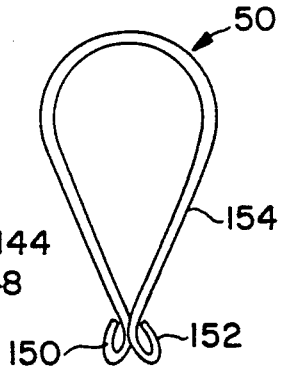
FIG. 29 is a view in elevation of the ear ornament made of spring material having hooks on the free ends in the open position.
Figure 30:
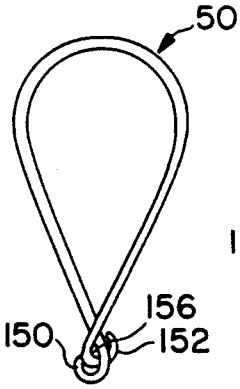
FIG. 30 is a view in elevation of the ear ornament of FIG. 29 with hooks in the engaged position.
Figure 31:
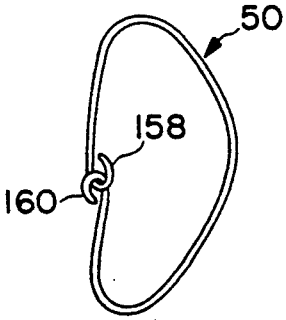
FIG. 31 is a view in elevation of the ear ornament of FIG. 29 with hooks at a different position on the ornament.
Figure 32:
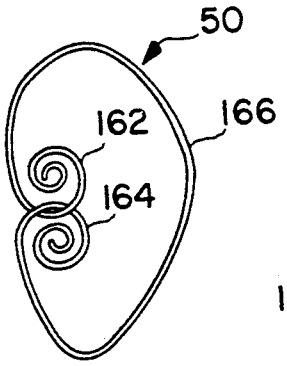
FIG. 32 is a view in elevation of the ear ornament having two ornamental hooks extending to the inside of the loop.
Figure 33:
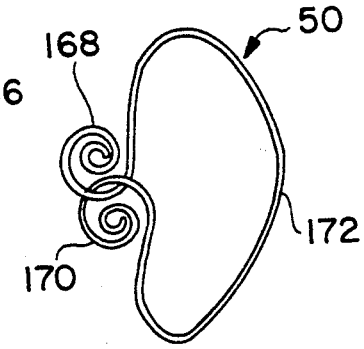
FIG. 33 is a view in elevation of the ear ornament with ornamental hooks extending to the outside of the loop.
Figure 34:
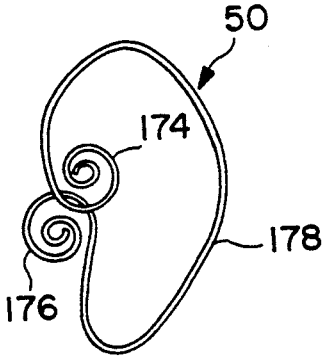
FIG. 34 is a view in elevation of the ear ornament having ornamental hooks extending to the inside and the outside of the loop.

FIGS. 28–34 and 50–51 illustrate another type of fastener means. Referring to FIG. 28, a hook 144 is made on one end of the loop 146 such that the other free end 148 of the loop 146 is received within the hook 144. The spring metal of the loop 146 maintains the free end 148 within the hook 144. FIGS. 29 and 30 illustrate hook 150, 152 on each free end of the loop 154 whereby the two hooks 150, 152 may be interlaced at 156 as shown in FIG. 30 for attachment. In FIG. 31–34, the hooks are placed in the front portion 30 of the loop 50. FIG. 31 illustrates two plain hooks 158, 160 while FIGS. 32–34 illustrate ornamental hooks. In FIG. 32 two ornamental coiled hooks 162, 164 are in the inside of the loop 166. In FIG. 33 the two hooks 168, 170 are on the outside of the loop 172. In FIG. 34, there is one hook 174 on the inside and one hook 176 on the outside of the loop 178. FIGS. 50 and 51 include an inner hook 244 extending inside the loop 50 and an outer hook 246 extending outside the loop 50. Hooks 244, 246 are intertwined to close the loop 50 by fastening the free ends.

FIG. 51 illustrates the attachment of a decorate ornament 248 to the outside hook 246.

Figure 35:
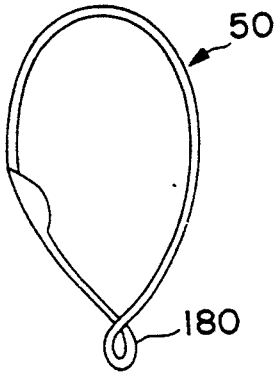
FIG. 35 is a view in elevation of the ear ornament having an additional crossing loop.
Figure 36:
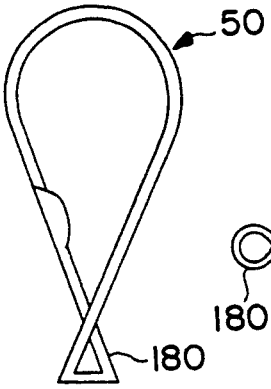
FIG. 36 is a view in elevation of the ear ornament like that of FIG. 35 with a crossing bend in the loop.
Figure 37:
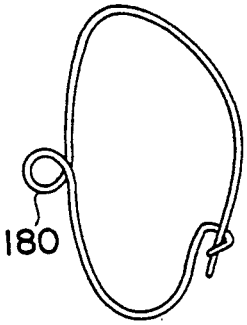
FIG. 37 is a view in elevation of the ear ornament having a crossing loop in the front portion of the loop.
Figure 38:
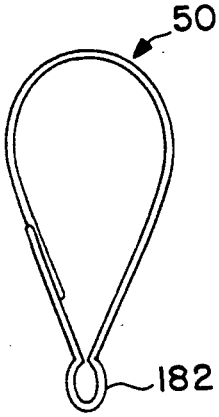
FIG. 38 is a view in elevation of the ear ornament having a non-crossing loop.
Figure 39:
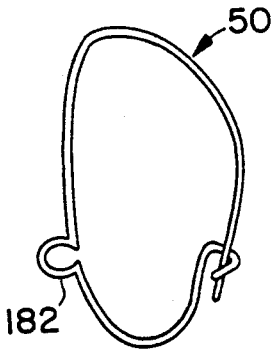
FIG. 39 is a view in elevation of the ear ornament like that of FIG. 37 with a non-crossing loop.

FIGS. 35–39 illustrate loops 50 with fastener means which include a small loop or bend in the loop 50 to enhance the spring action of the spring metal. FIGS. 35–37 show the small loops 180 crossing where FIGS. 38 and 39 merely show acute bends 182 in the loop. The small loops 180 and bends 182 also provide an ornamental pattern.

Figure 40:
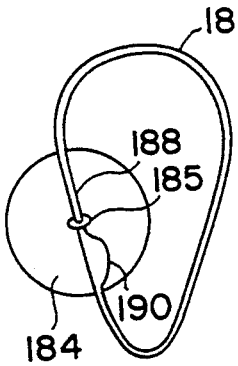
FIG. 40 is a view in elevation of the ear ornament having a decorative ornament mounted above the fastener means.
Figure 41:
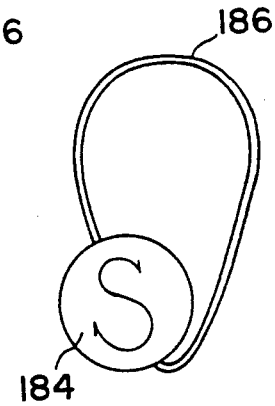
FIG. 41 is a view in elevation of the ear ornament of FIG. 40 with a decorative ornament below the fastener means.
Figure 42:
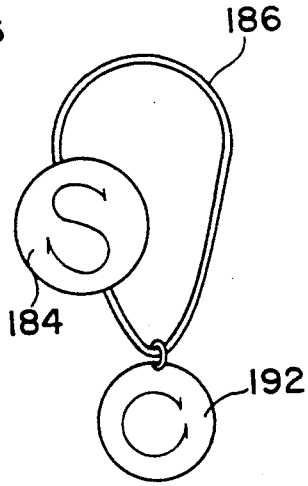
FIG. 42 is a front view in elevation of the ear ornament of FIG. 40 with an additional hanging ornament.
Figure 55:
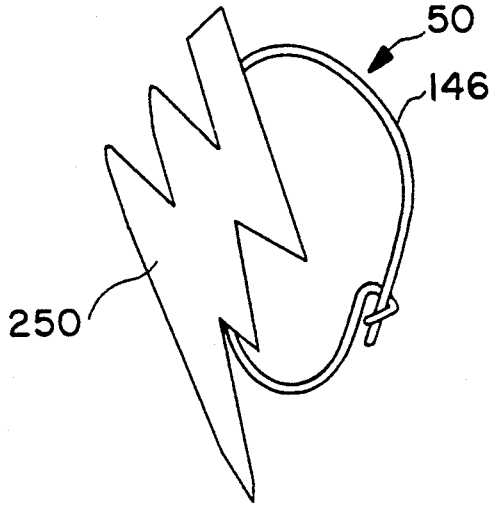
FIG. 55 is a view in elevation of the ear ornament having an eye and hook similar to that of FIG. 39 together with a decorative ornament attached thereto.
Figure 56:
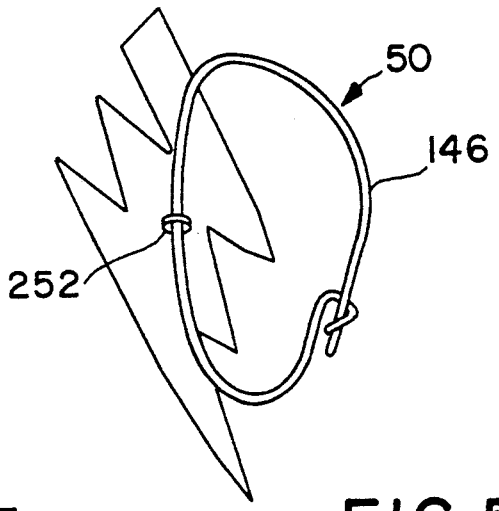
FIG. 56 is the back view of the ear ornament shown in FIG. 55.
Figure 57:
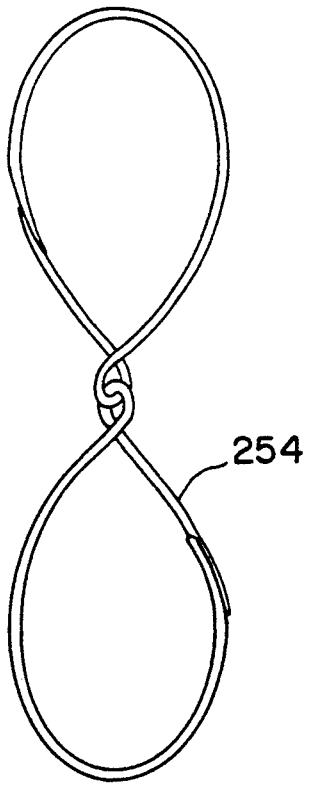
FIG. 57 is a view in elevation of the ear ornament of FIG. 35 having a second ornament similar to that of FIG. 35 as a decoration.
Figure 58:
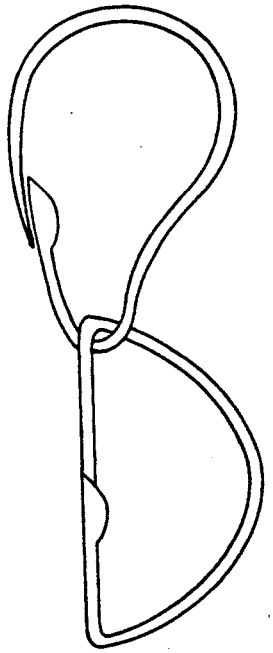
FIG. 58 is a view in elevation of the ear ornament similar to that of FIG. 24 with the ea loop shown in FIG. 22 as a detachable decorative ornament.

FIGS. 40–42 and 55–58 illustrate the attachment of an ornament to a loop 50. As shown in FIGS. 40 and 41, the ornament 184 includes a wire eye 185 which receives the free end 188 of the loop 186 prior to connecting the end 188 to cradle 190. By placing the ornament above the fastener means, the ornament 184 is held in a pre-determined position on the loop 186. FIG. 42 illustrates the hanging of additional ornaments 192 on the loop 186. FIGS. 55 and 56 illustrate the loop 146 of FIG. 28 having an ornament 250 attached. The ornament 250 includes a wire eye 252 which receives one end of the loop 146. FIGS. 57 and 58 show using a second ear loop as a decorative ornament. FIG. 57 shows a loop similar to that shown in FIG. 35 having a similar second loop 254 as a decorative ornament. FIG. 58 illustrates a loop of FIG. 24 as the ear ornament with the attached ear loop of FIG. 22 as a decorative ornament.

Figure 43:
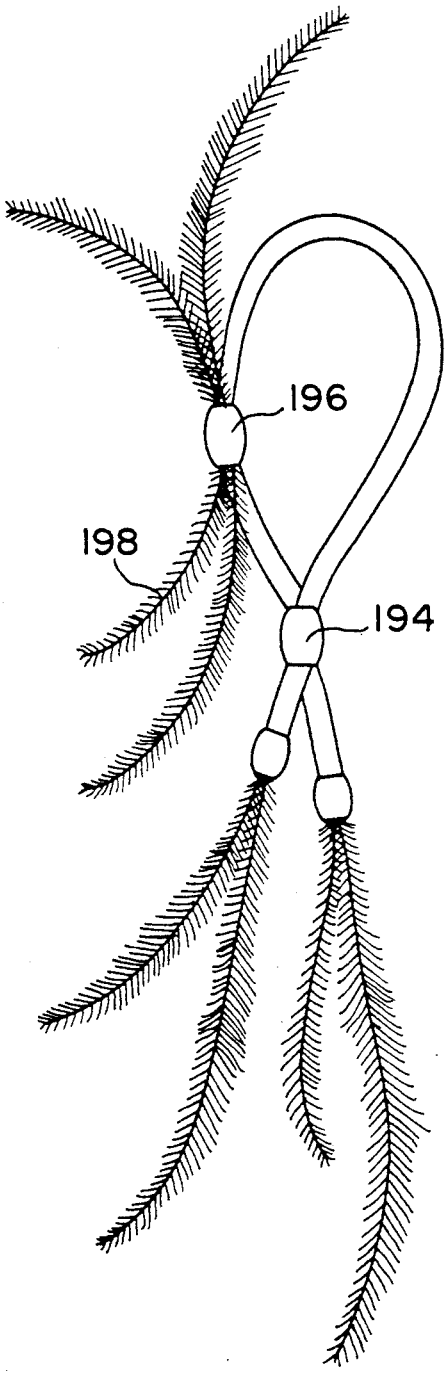
FIG. 43 is a view in elevation of the ear ornament made of rawhide passing through a bead for adjustment together with an decorative ornament such as a feather.
Figure 44:
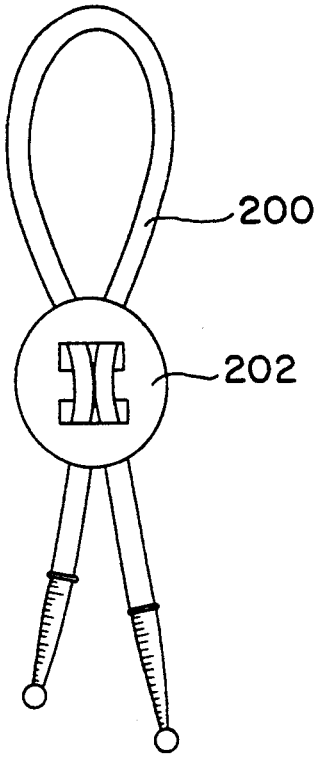
FIG. 44 is a view in elevation of the ear ornament of rawhide passing through a concho.
Figure 45:
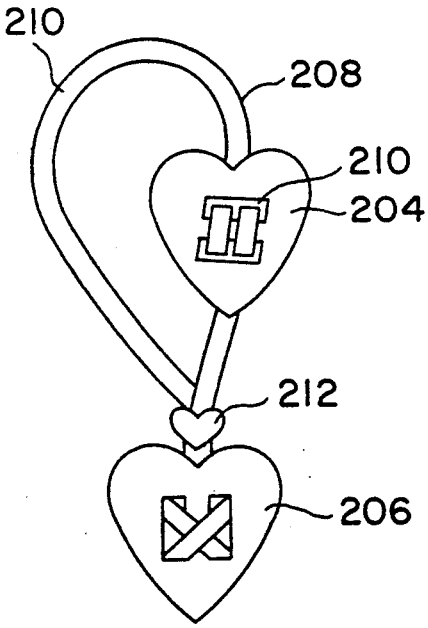
FIG. 45 is a view in elevation of the ear ornament made in cloth which wraps around ornaments for attachment.

FIGS. 43–45 demonstrate how the loop 50 can be made from a non-metal material such as rawhide or cloth. In FIG. 43, the material is threaded through beads 194 for adjustment and also includes beads 196 for adding feather accessories 198. FIG. 44 illustrates rawhide 200 laced through a concho 202. FIG. 44 also illustrates the drawstring method with the concho 201 as an accessory. In FIG. 45, accessories 204, 206 may be attached to the loop 208 of cloth by wrapping the cloth 210 through apertures 210 in the accessory 204 and typing the ends in accessory 206. A decorative loop 212 may hold the adjacent ends of the loop 208 together.

The attachments to the ear ornament are designed so that they slip onto the loop itself. This permits a variety of accessory designs. The accessories are not limited to any single place on the loop. Some examples include one that will cover the ear entrance to add decoration as well as possibly cover an inear hearing device. Other methods include the earlobe or dangle at the lower end of the loop below the ear.

One's own personal earrings, whether they be clip-on or pierced type, can be connected to or worn with the loop as an accessory. Another manner of use for the loop is for personal identification or as a plastic tube holding florescent fluid that glows in the dark.

While numerous embodiments of the present invention are illustrated in the drawings, it is to be understood that they are merely for the purpose of illustration and that various changes in construction and ornamentation may be resorted to in the course of design and manufacture in order that the invention may be utilized to the best advantage according to circumstances which may arise, without any manner departing from the spirit and intention of the invention, which is to be limited only in accordance with the appended claims. While there is stated the primary field of utility of the invention, it remains obvious that it may employed in any other capacity wherein it may be found applicable.

What is claimed is:

1. An ear ornament encircling the ear comprising:

an integral and rigid continuous member completely extending around the ear and conforming substantially to the back of the ear, said continuous member having a rigid upper engaging portion resting on the bridge of the ear; a rigid rear portion passing through the channel defined by the pinna of the ear, a rigid lower non-engaging portion extending adjacent the earlobe, and a rigid front portion which is bowed and extends in front of the ear.

2. The ear ornament of claim 1 wherein said member is made of rigid metal.

3. The ear ornament of claim 2 wherein said metal is covered with beads.

4. The ear ornament of claim 2 wherein said metal is covered with ribbon.

5. The ear ornament of claim 1 further including an ornament affixed to said member.

6. The ear ornament of claim 5 wherein said ornament is a button laced to said member.

7. The ear ornament of claim 5 wherein the ornament is integral to said member.

8. The ear ornament of claim 5 wherein said ornament includes artificial flowers attached to said member.

9. The ear ornament of claim 1 wherein said continuous member includes a secondary loop within said continuous member.

10. The ear ornament of claim 9, including means for attaching an ornament object to the secondary loop whereby the object is supported in front of the ear.

11. The ear ornament of claim 1 wherein the continuous member includes fastening means located on its lower portion.

12. The ornament of claim 11, wherein the object is held in a covering relation to the ear opening.

13. The ear ornament of claim 1, wherein the ornament is capable of supporting an ornamental object at any position around its circumference.

14. The ear ornament of claim 1, wherein the ornament is provided with a rigid secondary loop on its front portion adapted for detachably supporting an ornamental object to be held in front of the ear.

* * * * *